United States Patent [19]

Uemura et al.

[11] Patent Number: 4,469,667

[45] **Date of Patent: * Sep. 4, 1984**

[54] PROCESS FOR PRODUCTION OF PITCH-DERIVED CARBON FIBERS

[75] Inventors: Seiichi Uemura, Tokyo; Shunichi Yamamoto; Takao Hirose, both of Kamakura; Hiroaki Takashima, Kawasaki; Osamu Kato, Yokohama, all of Japan

[73] Assignee: Nippon Oil Co., Ltd., Tokyo, Japan

[ * ] Notice: The portion of the term of this patent subsequent to Jul. 5, 2000 has been disclaimed.

[21] Appl. No.: 451,939

[22] Filed: Dec. 21, 1982

[30] Foreign Application Priority Data

Dec. 28, 1981 [JP] Japan ..... 56-209649

[51] Int. Cl.[3] ..... D01F 9/12; C10C 3/02

[52] U.S. Cl. ..... 423/447.1; 423/447.6; 208/22; 208/40

[58] Field of Search ..... 423/447.1, 447.2, 447.4, 423/447.6, 447.7, 447.8; 208/22, 23, 40, 44, 45; 264/29.2

[56] References Cited

U.S. PATENT DOCUMENTS

| | | | |
|---|---|---|---|
| 4,177,132 | 12/1979 | Uemura et al. | 208/40 |
| 4,243,512 | 1/1981 | Seo | 423/447.1 |
| 4,271,006 | 6/1981 | Dickakian | 208/45 |
| 4,391,788 | 7/1983 | Uemura et al. | 423/447.6 |
| 4,397,830 | 8/1983 | Uemura et al. | 423/447.1 |

*Primary Examiner*—John Doll
*Assistant Examiner*—Steven Capella
*Attorney, Agent, or Firm*—Bucknam and Archer

[57] ABSTRACT

A process for the production of high performance carbon fibers which comprises using as the starting material a specific pitch having the lowest reflectivity in the range of 8.5–9.3% and the highest reflectivity in the range of 11.8–12.5%.

6 Claims, No Drawings

PROCESS FOR PRODUCTION OF PITCH-DERIVED CARBON FIBERS

This invention relates to an excellent specific pitch for producing high performance carbon fibers.

There have recently been reported many methods for producing carbon fibers from pitch. It is said that, in the case of production of carbon fibers from pitch, the tensile modulus, tensile strength and the like of the resulting carbon fibers depend greatly upon the properties of the pitch. For example, Japanese Patent Gazette 55-37611 describes that the use of a pitch containing 40–90% of mesophase portions is essential in the production of high performance carbon fibers. However, it is necessary to heat treat pitch at a temperature of at least 350° C. for usually 10 hours in order to obtain a pitch containing 40–90% of mesophase. In addition, since such a mesophase-containing pitch has a softening point of usually at least 300° C., the melt spinning thereof must be effected at a high temperature of at least 350° C. The higher softening point a pitch has, the higher the temperature needed for melt spinning the pitch is; this is not only economically disadvantageous but also tends to cause thermal degradation, such as an increase in quinoline-insoluble ingredients and evolution of decomposition gases, in the pitch in the melt spinning step thereby rendering it difficult to obtain high performance carbon fibers.

An object of this invention is to provide a specific reformed pitch which may be prepared in a comparatively short time, has a low softening point and is excellent for use as material for producing high performance carbon fibers. Thus, the specific pitch according to this invention will produce high performance carbon fibers therefrom.

The process of this invention comprises producing high performance carbon fibers from a specific pitch having the lowest reflectivity in the range of 8.5–9.3% and the highest reflectivity in the range of 11.8–12.5%.

The reflectivity is determined by embedding a test pitch in a resin such as an acryl resin, grinding the pitch-embedded resin until the pitch surface appears outside and then measuring the pitch surface reflectivity in air by an apparatus for measurement of reflectivity. More particularly, at least 100 sites are optionally selected on the pitch surface, the pitch surface is rotated 360° C. around each of the sites as the rotation center to measure the maximum and minimum reflectivities at each site. The highest value of the maximum reflectivities measured and the lowest value of the minimum reflectivities measured are taken as the highest and lowest reflectivities for the test pitch.

It is only a specific pitch having the thus measured lowest value in the range of 8.5–9.3% and the thus measured highest value in the range of 11.8–12.5% that is most suitable as pitch for producing high performance carbon fibers therefrom. A pitch having at least one of its highest and lowest reflectivities falling outside the corresponding specified reflectivity ranges, has no longer excellent properties necessary for a pitch for carbon fibers whereby it cannot produce high performance carbon fibers therefrom.

The method for preparing a specific pitch having the specified reflectivities according to this invention as well as a starting pitch for preparing the specific pitch therefrom, is not particularly limited.

The starting pitches used herein are carbonaceous pitches such as a coal-derived pitch and petroleum-derived pitch, among which is preferred a pitch containing no mesophase portions and having a softening point of 50°–200° C.

The starting carbonaceous pitches suitable for producing the specific pitches are illustrated by:

(1) a heavy fraction oil boiling at substantially 200°–450° C. obtained as a by-product at the time of steam cracking of petroleum, such as naphtha, kerosene or light oil, at usually 700°–1200° C. to produce olefins such as ethylene and propylene, (2) a heavy fraction oil boiling at substantially 200°–450° C. obtained as a by-product at the time of fluidized catalytic cracking of petroleum such as kerosene, light oil or atmospheric pressure bottom oils at a temperature of 450°–550° C. and a pressure of atmospheric to 20 $Kg/cm^2.G$ in the presence of natural or synthetic silica.alumina catalyst or zeolite catalyst, (3) a pitch obtained by incorporating 100 parts by volume of said heavy fraction oil (1) with 10–200 parts by volume of aromatic hydrocarbons of 2–3 rings having their nuclei at least partly hydrogenated to form a mixed oil and then heat treating the thus formed mixed oil at a temperature of 370°–480° C. and a pressure of 2–50 $Kg/cm^2.G$, (4) a pitch obtained by incorporating 100 parts by volume of said heavy fraction oil (2) with 10–200 parts by volume of aromatic hydrocarbons of 2–3 rings having their nuclei at least partly hydrogenated to form a mixture and then heat treating the thus formed mixture at a temperature of 370°–480° C. and a pressure of 2–50 $Kg/cm^2.G$, (5) a pitch obtained by heat treating said heavy fraction (1) at a temperature of 400°–500° C. under a hydrogen pressure of 20–350 $Kg/cm^2.G$, (6) a pitch obtained by heat treating said heavy fraction oil (2) at a temperature of 400°–500° C. under a hydrogen pressure of 20–350 $Kg/cm^2.G$, (7) a pitch obtained by (A) incorporating 100 parts by volume of said heavy fraction oil (1) with 10–200 parts by volume of a hydrogenated oil (2) obtained by contacting with hydrogen in the presence of a hydrogenating catalyst a fraction (i) boiling at 160°–400° C. produced at the time of steam cracking of petroleum and/or a fraction (ii) boiling between 160°–400° C. produced at the time of heat treating at 370°–480° C. a heavy fraction oil boiling at not lower than 200° C. obtained at the time of steam cracking of petroleum, to hydrogenate 10–70% of aromatic nuclei of the aromatic hydrocarbons contained in the fractions (i) and (ii) thereby to obtain a mixture of the oils (1) and (2) and then (B) heat treating the thus obtained mixture at a temperature of 370°–480° C. under a pressure of 2–50 $Kg/cm^2.G$ thereby obtaining the pitch, and (8) a pitch obtained by mixing together the heavy fraction oil (1), heavy fraction oil (2) and hydrogenated oil (7) in such amounts that the ratio by weight of said heavy fraction oil (1) to said heavy fraction oil (2) is 1:0.1–9 and the ratio by weight of the total of said heavy fraction oils (1) and (2) to said hydrogenated oil (7) is 1:0.1–2, to obtain a mixture and then heat treating the thus obtained mixture at a temperature of 370°–480° C. under a pressure of 2–50 $Kg/cm^2.G$ thereby obtaining the pitch. Among the abovementioned starting pitches for producing the specific pitch according to this invention, the pitches (2), (4), (6), (7) and (8) are preferred.

The nucleus-hydrogenated aromatic hydrocarbons of 2-3 rings used in the preparation of the pitches (3) and (4) include naphthalene, indene, biphenyl, acenaphthylene, anthracene, phenanthren and their $C_{1-3}$ alkyl-substituted compounds, in each of which 10-100%, preferably 10-70% of the aromatic nuclei have been hydrogenated. More specifically, they include decalin, methyldecalin, tetralin, methyltetralin, dimethyltetralin, ethyltetralin, isopropyltetralin, indane, decahydrobiphenyl, acenaphthene, methylacenaphthene, tetrahydroacenaphthene, dihydroanthracene, methylhydroanthracene, dimethylhydroanthracene, ethylhydroanthracene, tetrahydroanthracene, hexahydroanthracene, octahydroanthracene, dodecahydroanthracene, tetradecahydroanthracene, dihydrophenanthrene, methyldihydrophenanthrene, tetrahydrophenanthrene, hexahydrophenanthrene, octahydrophenanthrene, dodecahydrophenanthrene and tetradecahydrophenanthrene. They may be used alone or in combination. Particularly preferred are nucleus-hydrogenated aromatic hydrocarbons obtained from bicyclic or tricyclic condensed aromatic hydrocarbons.

The methods for producing the specific pitches according to this invention are not specifically limited. These specific pitches may be obtained, for example, by a method comprising melting the starting material for the specific pitches to make it liquid in an inert gas atmosphere, forming the melted liquid material into a filmy shape having a thickness of preferably up to 5 mm, heat treating the thus obtained films at 200°-350° C., preferably 250°-345° C., and a reduced pressure, preferably 0.1-10 mmHg, for 1-30 minutes, preferably 5-20 minutes and then further heat treating the thus heat treated films at 300°-450° C., preferably 350°-400° C., for 1-60 minutes, preferably 5-40 minutes. By the use of such treatments, the starting material may be converted to a desired specific pitch having the lowest reflectivity in the range of 8.5-9.3% and the highest reflectivity in the range of 11.8-12.5%.

The specific pitches having the specified reflectivities according to this invention are melt spun by a usual method to obtain pitch fibers, infusibilized, carbonized or further graphitized to obtain carbon fibers having high tensile modulus and high tensile strength.

The melt spinning may be effected usually by adjusting the melt spinning temperature to a temperature approximately 40°-70° C. higher than the softening point of the specific pitch and extruding the thus melted pitch through nozzles having a diameter of 0.1-0.5 mm so that the resulting carbon fibers are taken up at a velocity of 200-2000 m/min. on take-up rolls.

The pitch fibers obtained by melt spinning the starting pitch are then infusibilized in an oxidizing gas atmosphere (20-100% concentration). The oxidizing gases which may usually be used herein, include oxygen, ozone, air, nitrogen oxides, halogen and sulfurous acid gas. These oxidizing gases may be used singly or in combination. The infusibilizing treatment may be effected at such a temperature that the pitch fibers obtained by melt spinning are neither softened nor deformed; thus, the infusibilizing temperature may be, for example, 20°-360° C., preferably 20°-300° C. The time for the infusibilization may usually be in the range of 5 minutes to 10 hours.

The pitch fibers so infusibilized are then carbonized or further graphitized to obtain carbon fibers. The carbonization or graphitization is effected by heating the infusibilized pitch fibers at a heat-raising rate of 5°-20° C./min. to 800°-3500° C. and maintaining them at this temperature for one second to one hour.

EXAMPLE 1

There was obtained a heavy fraction oil (A) boiling at not lower than 200° C. produced as a by-product at the time fluidized catalytic cracking at 500° C. of light oil in the presence of zeolite catalyst. The characteristics of the thus obtained oil (E) are as shown in Table 1.

TABLE 1

Distillation Characteristics of Heavy Fraction Oil (A)

| | | |
|---|---|---|
| Specific gravity (15° C./4° C.) | | 0.965 |
| Distillation characteristics | Initial boiling point | 320 (°C.) |
| | 5 (%) | 340 |
| | 10 | 353 |
| | 20 | 370 |
| | 30 | 385 |
| | 40 | 399 |
| | 50 | 415 |
| | 60 | 427 |
| | 70 | 445 |

One hundred and fifty (150) ml of the thus obtained heavy fraction oil (A) were introduced into a 300-ml autoclave provided with an agitator, heated at 3° C./min. to 430° C. under an initial hydrogen pressure of 100 Kg/cm$^2$.G and maintained at this temperature for 3 hours, after which the heating was stopped and the reaction product cooled to room temperature. The resulting liquid product was distilled at 250° C./1 mmHg to distil off the light fraction thereby obtaining a pitch (1). The thus obtained starting pitch (1) had a softening point of 68° C.

The starting pitch (1) was treated at a temperature of 345° C. and a reduced pressure of 1 mmHg for 15 minutes by the use of a film evaporator and then heat treated at 350° C. at atmospheric pressure for 15 minutes to obtain a specific pitch (2) having a softening point of softening point of 245° C. The thus obtained specific pitch (2) was measured for reflectivity by the use of a reflectivity measuring apparatus produced by Leiz Company (Ernst Leitz G.m.b.H.) with the result that the highest value was 12.0% and the lowest value was 8.8%. The specific pitch (2) so obtained was melt spun at a spinning temperature of 310° C. and a take-up velocity of 800 m/min. by the use of a spinner having 0.3 mm-diameter nozzles and L/D=1 to obtain 12μ-diameter pitch fibers which were infusibilized, carbonized and graphitized under the following conditions to obtain carbon fibers.

Infusibilizing conditions: Raised at 1° C./min. to 300° C. and maintained at this temperature for 30 minutes in air.

Carbonizing conditions: Raised at 10° C./min. to 1000° C. and maintained at this temperature for 30 minutes in a nitrogen atmosphere.

Graphitizing conditions: Raised at 50° C./min. to 2000° C. and maintained at this temperature for one minute in an argon stream for heat treatment.

The carbon fibers so obtained had a 11μ-diameter, a tensile strength of 230 Kg/mm$^2$ and a tensile modulus of 25 ton/mm$^2$.

COMPARATIVE EXAMPLE 1

The starting pitch (1) as obtained in Example 1 was heat treated at 400° C. for 6 hours while being agitated by passing nitrogen to the pitch at a flow rate of 2 ml/min. per gram of the pitch (1) to obtain a pitch (3) having a softening point of 263° C. The thus obtained pitch (3) was measured for reflectivity with the result that the highest and lowest values were 12.4% and 8.4% respectively.

The pitch (3) was attempted to be melt spun at a spinning temperature of 320° C. and a take-up velocity of 800 m/min. by the use of the same spinner as used in Example 1, however, it was impossible to melt spin the pitch uniformly.

EXAMPLE 2

There was recovered a heavy fraction oil (B) produced as a by-product at the time of steam cracking naphtha at 830° C. The characteristics of the heavy fraction oil (B) are as shown in Table 2. The oil (B) was heat treated at 400° C. and 15 Kg/cm$^2$.G for 3 hours to obtain a heat treated oil (C). The thus obtained oil (C) was distilled at 250° C./1.0 mmHg to obtain a fraction (D) boiling at 160°–400° C. The characteristics of the fraction (D) are as shown in Table 3. The fraction (D) was contacted with hydrogen at 330° C., 35 Kg/cm$^2$.G and a LHSV of 1.5 to effect partial nuclear hydrogenation thereby obtaining a hydrogenated oil (E). The degree of nuclear hydrogenation was 31%.

Fifty (50) parts by volume of the heavy fraction oil (B) were mixed with 50 parts by volume of the hydrogenated oil (E) to form a mixture which was heat treated at 430° C. and 20 Kg/cm$^2$.G for 3 hours to obtain a heat treated oil. The thus obtained heat treated oil was distilled at 250° C./1.0 mmHg to distil off the light fraction thereby obtaining a starting pitch (4) having a softening point of 100° C.

The thus obtained starting pitch (4) was heat treated at 345° C. at a reduced pressure of 1 mmHg for 15 minutes by the use of a film evaporator and then further heat treated at 380° under atmospheric pressure for 30 minutes to obtain a specific pitch (5) having a softening point of 232° C. The pitch (5) so obtained was measured for reflectivity with the result that the highest and lowest values were 12.3% and 9.1% respectively.

This pitch (5) was melt spun at a spinning temperature of 315° C. and a take-up velocity of 800 m/min. by the use of the same spinner as used in Example 1 to obtain 13μ-diameter pitch fibers which were infusibilized, carbonized and graphitized to obtain carbon fibers having an 11μ-diameter, a tensile strength of 220 Kg/mm$^2$ and a tensile modulus of 24 Ton/mm$^2$.

TABLE 2

| Distillation Characteristics of Heavy Fraction Oil (B) | | |
|---|---|---|
| Specific gravity (15° C./4° C.) | | 1.039 |
| Distillation characteristics | Initial boiling point | 192 (°C.) |
| | 5 (%) | 200 |
| | 10 | 206 |
| | 20 | 217 |
| | 30 | 227 |
| | 40 | 241 |
| | 50 | 263 |
| | 60 | 290 |
| | 70 | 360 |

TABLE 3

| Distillation Characteristics of Fraction (D) | | |
|---|---|---|
| Specific gravity (15° C./4° C.) | | 0.991 |
| Refractive index ($n_D^{25}$) | | 1.5965 |
| Molecular weight | | 145 |
| Distillation characteristics | Initial boiling point | 160 (°C.) |
| | 10 (%) | 200 |
| | 30 | 215 |
| | 50 | 230 |
| | 70 | 256 |
| | 90 | 305 |

COMPARATIVE EXAMPLE 2

The pitch (4) as obtained in Example 2 was heat treated at 400° C. for 12 hours while being agitated by passing nitrogen at a flow rate of 2 ml/min. per gram of the pitch (4) to obtain a pitch (6) having a softening point of 301° C. The thus obtained pitch (6) was measured for reflectivity with the result that the highest and lowest values were 13.3% and 9.1% respectively.

The pitch (6) was attempted to be melt spun at a spinning temperature of 355° C. and a take-up velocity of 800 m/min. by the use of the spinner as used in Example 1 with the result that the pitch (6) was thermally degraded whereby continuous spinning was impossible.

EXAMPLE 3

Sixty (60) parts by weight of the heavy fraction oil (A) as obtained in Example 1, 30 parts by weight of the heavy fraction oil (B) as obtained in Example 2 and 10 parts by weight of the hydrogenated oil (E) as obtained in Example 2, were mixed together to form a mixed oil which was then heat treated at 430° C. and 20 Kg/cm$^2$.G for 3 hours to obtain a heat treated oil. The thus obtained heat treated oil was distilled at 250° C./1.0 mmHg to distil off the light fraction thereby obtaining a starting pitch (7) having a softening point 80° C.

The starting pitch (7) so obtained was treated at 345° C. and a reduced pressure of 1 mmHg for 15 minutes by the use of a film evaporator and then heat treated at 370° C. at atmospheric pressure for 20 minutes to obtain a specific pitch (8) having a softening point of 261° C. The thus obtained pitch (8) was measured for reflectivity with the result that the highest and lowest values are 12.4% and 9.0% respectively.

The pitch (8) was melt spun at a spinning temperature of 320° C. and a take-up speed of 780 m/min. to obtain 12μ-diameter pitch fibers. The thus obtained pitch fibers were infusibilized, carbonized and graphitized under the same conditions as in Example 1 to obtain carbon fibers having a 10μ-diameter, a tensile strength of 220 Kg/mm$^2$ and a tensile modulus of 23 Ton/mm$^2$.

COMPARATIVE EXAMPLE 3

The pitch (7) as obtained in Example 3 was heat treated at 400° C. and a reduced pressure of 1 mmHg for 10 hours to obtain a pitch (9) having a softening point of 299° C. and a reflectivity of 13.2% at the highest and 9.0% at the lowest.

The thus obtained pitch (9) was attempted to be melt spun at a spinning temperature of 360° C. and a take-up velocity of 780 m/min. with the result that the pitch (9) was thermally degraded whereby continuous spinning thereof was impossible.

What is claimed is:

1. A process for the production of carbon fibers comprising melt spinning a pitch to obtain pitch fibers, infusibilizing the thus obtained pitch fibers, carbonizing or further graphitizing the thus infusibilized pitch fibers to obtain high performance carbon fibers, wherein said pitch is a specific pitch which is obtained by heating a starting pitch in an inert gas atmosphere to obtain a liquid pitch, forming the thus obtained liquid pitch to a thin film of not larger than 5 mm in thickness, treating the thus formed thin film at a temperature of 200°-350° C. and a reduced pressure of 0.1-10 mm Hg for 1-30 minutes and then heat treating the thus treated thin film at a temperature of 300°-450° C. under atmospheric pressure for 1-60 minutes, to obtain said specific pitch, wherein said specific pitch has the lowest reflectivity in the range of 8.5-9.3% and the highest reflectivity in the range of 11.8-12.5%, wherein the starting pitch is a pitch obtained by incorporating 100 parts by volume of a heavy fraction oil boiling at substantially 200°-450° C. obtained as a by-product at the time of steam cracking at 700°-1200° C. of petroleum comprising at least one member selected from naphtha, kerosene and light oil to produce olefins including ethylene and propylene, with 10-200 parts by volume of aromatic hydrocarbons of 2-3 rings having their nuclei at least partly hydrogenated to form a mixed oil and then heat treating the thus formed mixed oil at a temperature of 380°-480° C. and a pressure of 2-50 Kg/cm$^2$.G.

2. A process for the production of carbon fibers comprising melt spinning a pitch to obtain pitch fibers, infusibilizing the thus obtained pitch fibers, carbonizing or further graphitizing the thus infusibilized pitch fibers to obtain high performance carbon fibers, wherein said pitch is a specific pitch which is obtained by heating a starting pitch in an inert gas atmosphere to obtain a liquid pitch, forming the thus obtained liquid pitch to a thin film of not larger than 5 mm in thickness, treating the thus formed thin film at a temperature of 200°-350° C. and a reduced pressure of 0.1-10 mm Hg for 1-30 minutes and then heat treating the thus treated thin film at a temperature of 300°-450° C. under atmospheric pressure for 1-60 minutes, to obtain said specific pitch, wherein said specific pitch has the lowest reflectivity in the range of 8.5-9.3% and the highest reflectivity in the range of 11.8-12.5%, wherein the starting pitch is a pitch obtained by incorporating 100 parts by volume of a heavy fraction oil boiling at substantially 200°-450° C. obtained as a by-product at the time of fluidized catalytic cracking of petroleum comprising at least one member selected from kerosene, light oil and atmospheric pressure bottom oils, at a temperature of 450°-550° C. and a pressure of atmospheric to 20 Kg/cm$^2$.G in the presence of natural or synthetic silica.alumina catalyst or zeolite catalyst, with 10-200 parts by volume of aromatic hydrocarbons of 2-3 rings having their nuclei at least partly hydrogenated to form a mixture and then heat treating the thus formed mixture at a temperature of 380°-480° C. and a pressure of 2-50 Kg/cm$^2$.G.

3. A process for the production of carbon fibers comprising melt spinning a pitch to obtain pitch fibers, infusibilizing the thus obtained pitch fibers, carbonizing or further graphitizing the thus infusibilized pitch fibers to obtain high performance carbon fibers, wherein said pitch is a specific pitch which is obtained by heating a starting pitch in an inert gas atmosphere to obtain a liquid pitch, forming the thus obtained liquid pitch to a thin film of not larger than 5 mm in thickness, treating the thus formed thin film at a temperature of 200°-350° C. and a reduced pressure of 0.1-10 mm Hg for 1-30 minutes and then heat treating the thus treated thin film at a temperature of 300°-450° C. under atmospheric pressure for 1-60 minutes, to obtain said specific pitch, wherein said specific pitch has the lowest reflectivity in the range of 8.5-9.3% and the highest reflectivity in the range of 11.8-12.5%, wherein the starting pitch is a pitched obtained by heat treating a heavy fraction oil boiling at substantially 200°-450° C. obtained as a by-product at the time of steam cracking at 700°-1200° C. of petroleum comprising at least one member selected from naphtha, kerosene and light oil to produce olefins including ethylene and propylene at a temperature of 400°-500° C. under a hydrogen pressure of 20-350 Kg/cm$^2$.G.

4. A process for the production of carbon fibers comprising melt spinning a pitch to obtain pitch fibers, infusibilizing the thus obtained pitch fibers, carbonizing or further graphitizing the thus infusibilized pitch fibers to obtain high performance carbon fibers, wherein said pitch is a specific pitch which is obtained by heating a starting pitch in an inert gas atmosphere to obtain a liquid pitch, forming the thus obtained liquid pitch to a thin film of not larger than 5 mm in thickness, treating the thus formed thin film at a temperature of 200°-350° C. and a reduced pressure of 0.1-10 mm Hg for 1-30 minutes and then heat treating the thus treated thin film at a temperature of 300°-450° C. under atmospheric pressure for 1-60 minutes, to obtain said specific pitch, wherein said specific pitch has the lowest reflectivity in the range of 8.5-9.3% and the highest reflectivity in the range of 11.8-12.5%, wherein the starting pitch is a pitch obtained by heat treating at a temperature of 400°-500° C. under a hydrogen pressure of 20-350 Kg/cm$^2$.G a heavy fraction oil boiling at substantially 200°-450° C. obtained as a by-product at the time of fluidized catalytic cracking of petroleum comprising at least one member selected from kerosene, light oil and atmospheric pressure bottom oils, at a temperature of 450°-550® C. and a pressure of atmospheric to 20 Kg/cm$^2$.G in the presence of natural or synthetic silica.alumina catalyst or zeolite catalyst.

5. A process for the production of carbon fibers comprising melt spinning a pitch to obtain pitch fibers, infusibilizing the thus obtained pitch fibers, carbonizing or further graphitizing the thus infusibilized pitch fibers to obtain high performance carbon fibers, wherein said pitch is a specific pitch which is obtained by heating a starting pitch in an inert gas atmosphere to obtain a liquid pitch, forming the thus obtained liquid pitch to a thin film of not larger than 5 mm in thickness, treating the thus formed thin film at a temperature of 200°-350° C. and a reduced pressure of 0.1-10 mm Hg for 1-30 minutes and then heat treating the thus treated thin film at a temperature of 300°-450° C. under atmospheric pressure for 1-60 minutes, to obtain said specific pitch, wherein said specific pitch has the lowest reflectivity in the range of 8.5-9.3% and the highest reflectivity in the range of 11.8-12.5%, wherein the starting pitch is a pitch obtained by (A) incorporating 100 parts by volume of a heavy fraction oil boiling at substantially 200°-450° C. obtained as a by-product at the time of steam cracking at 700°-1200° C. of petroleum comprising at least one member selected from naphtha, kerosene and light oil to produce olefins including ethylene and propylene, with 10-200 parts by volume of a hydrogenated oil obtained by contacting with hydrogen in the presence of a hydrogenating catalyst a fraction (i) boiling at 160°-400° C. produced at the time of steam cracking of petroleum or a fraction (ii) boiling between 160°-400° C. produced at the time of heat treating at 380°–480° C. a heavy fraction oil boiling at now lower than 200° C. obtained at the time of steam cracking of petroleum or a mixture of said fractions (i) and (ii), to hydrogenate 10–70% of aromatic nuclei of the aromatic hydrocarbons contained in the fractions (i) and (ii) thereby to obtain a mixture of the oils and then (B) heat treating the thus obtained mixture at a temperature of 380°–480° C. under a pressure of 2–50 Kg/cm$^2$.G thereby obtaining the starting pitch.

6. A process for the production of carbon fibers comprising melt spinning a pitch to obtain pitch fibers, infusibilizing the thus obtained pitch fibers, carbonizing or further graphitizing the thus infusibilized pitch fibers to obtain high performance carbon fibers, wherein said pitch is a specific pitch which is obtained by heating a starting pitch in an inert gas atmosphere to obtain a liquid pitch, forming the thus obtained liquid pitch to a thin film of not larger than 5 mm in thickness, treating the thus formed thin film at a temperature of 200°–350° C. and a reduced pressure of 0.1–10 mm Hg for 1–30 minutes and then heat treating the thus treated thin film at a temperature of 300°–450° C. under atmospheric pressure for 1–60 minutes, to obtain said specific pitch, wherein said specific pitch has the lowest reflectivity in the range of 8.5–9.3% and the highest reflectivity in the range of 11.8–12.5%, wherein the starting pitch is a pitch obtained by mixing together (a) a heavy fraction oil boiling at substantially 200°–450° C. obtained as a by-product at the time of steam cracking at 700°–1200° C. of petroleum comprising at least one member selected from naphtha, kerosene and light oil to produce olefins including ethylene and propylene, (b) a heavy fraction oil boiling at substantially 200°–450° C. obtained as a by-product at the time of fluidized catalytic cracking of petroleum comprising at least one member selected from kerosene, light oil and atmospheric pressure bottom oils, at a temperature of 450°–550° C. and a pressure of atmospheric to 20 Kg/cm$^2$.G in the presence of natural or synthetic silica.alumina catalyst or zeolite catalyst and (c) a hydrogenated oil obtained by contacting with hydrogen in the presence of a hydrogenating catalyst a fraction (i) boiling at 160°–400° C. produced at the time of steam cracking of petroleum or a fraction (ii) boiling between 160°–400° C. produced at the time of heat treating at 380°–480° C. a heavy fraction oil boiling at not lower than 200° C. obtained at the time of steam cracking of petroleum or a mixture of said fraction (i) and said fraction (ii), to hydrogenate 10–70% of aromatic nuclei of the aromatic hydrocarbons contained in the fractions (i) and (ii), in such amounts that the ratio by weight of said heavy fraction oil (a) to said heavy fraction oil (b) is 1:0.1–9 and the ratio by weight of the total of said heavy fraction oils (a) and (b) to said hydrogenated oil (c) is 1:0.1–2, to obtain a mixture and then heat treating the thus obtained mixture at a temperature of 380°–480° C. under a pressure of 2–50 Kg/cm$^2$.G.

* * * * *